United States Patent [19]

Roe

[11] 4,326,847

[45] Apr. 27, 1982

[54] LAUNCH ENVIRONMENT SIMULATOR

[75] Inventor: George W. Roe, Rockledge, Fla.

[73] Assignee: McDonnell Douglas Corporation, Long Beach, Calif.

[21] Appl. No.: 105,991

[22] Filed: Dec. 21, 1979

[51] Int. Cl.[3] ..... F41F 27/00; G09B 9/00

[52] U.S. Cl. ..... 434/12

[58] Field of Search ..... 35/25; 89/7; 102/39, 102/204, 28 R; 124/55, 56; 434/11, 12, 18

[56] References Cited

U.S. PATENT DOCUMENTS

| | | | |
|---|---|---|---|
| 827,789 | 8/1906 | Crane et al. | 124/55 X |
| 1,127,480 | 2/1915 | Maxwell | 229/1.5 B |
| 1,337,566 | 4/1920 | Pierce | 89/7 |
| 1,734,477 | 11/1929 | Fowle | 229/1.5 B |
| 2,094,854 | 10/1937 | Smith | 89/7 |
| 2,673,496 | 3/1954 | Amberg et al. | 229/1.5 B X |
| 2,674,923 | 4/1954 | Brandt | 35/25 |
| 2,723,643 | 11/1955 | Weiss | 229/1.5 B X |
| 3,112,671 | 12/1963 | Dunham et al. | 434/12 |
| 3,169,483 | 2/1965 | Gawlick et al. | 102/204 |
| 3,238,642 | 3/1966 | Ohlund | 35/25 |
| 3,850,862 | 11/1974 | Clendinning et al. | 220/DIG. 30 X |
| 4,245,403 | 1/1981 | Hipp | 434/11 |

*Primary Examiner*—William H. Grieb

*Attorney, Agent, or Firm*—Gregory A. Cone; Walter J. Jason; Donald L. Royer

[57] ABSTRACT

Firing and subsequent aiming-tracking of a tube-launched projectile are realistically simulated by a launch environment simulator comprising a launch tube, means for delivering a combustible gas mixture to the launch tube, means for igniting the gas within the tube, an effectively orificed end plate disposed at the rear end of the tube to provide realistic recoil upon firing, and confining end caps at both ends of the tube which disintegrate upon ignition of the gas mixture.

12 Claims, 10 Drawing Figures

FIG. 3
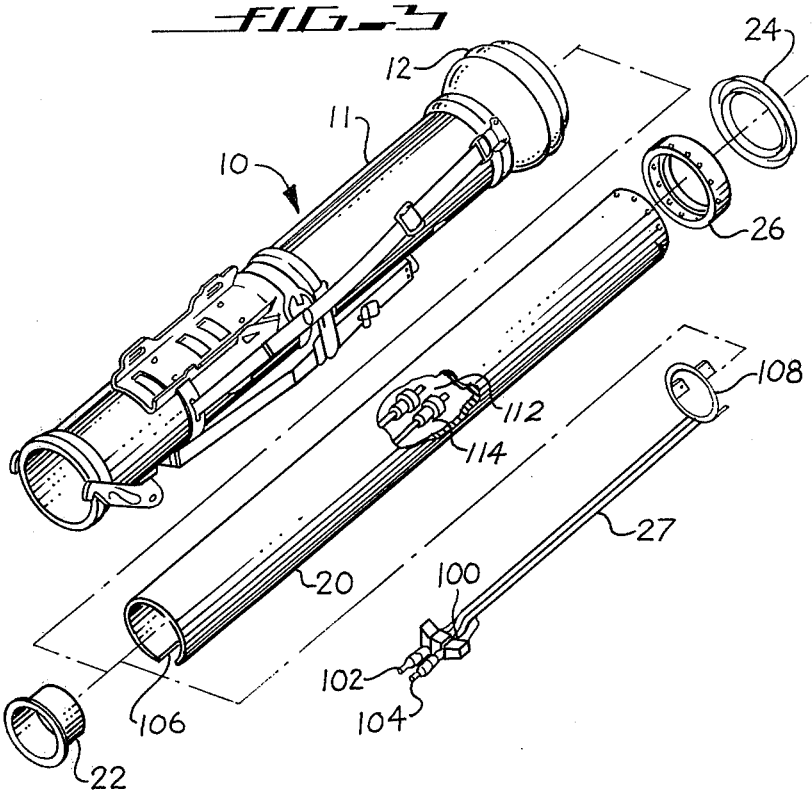
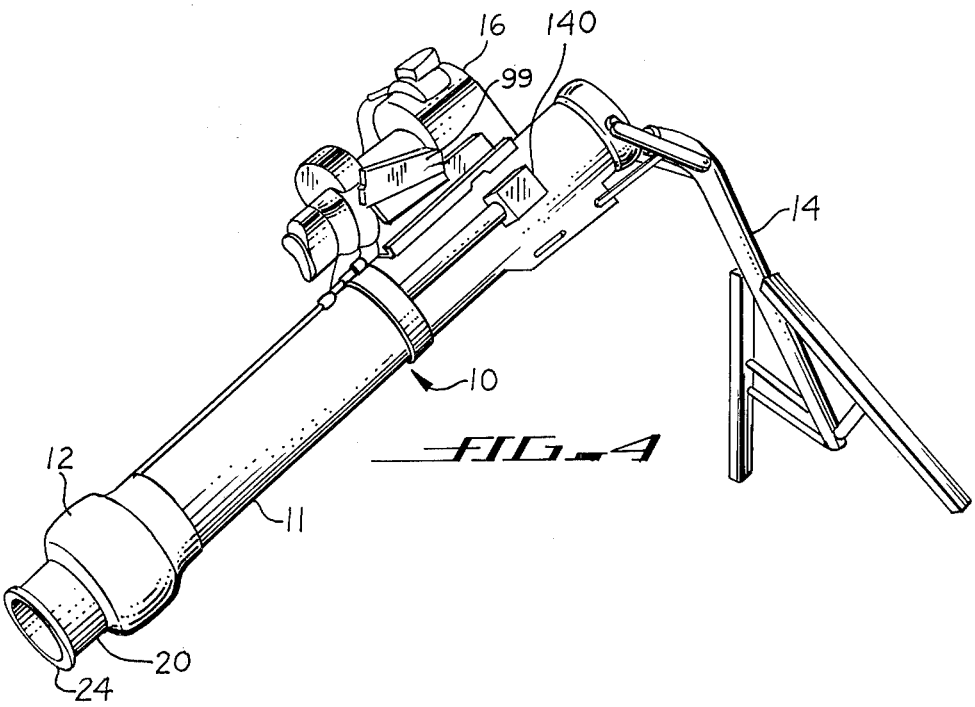
FIG. 4

LAUNCH ENVIRONMENT SIMULATOR

BACKGROUND OF THE INVENTION

1. Field of the Invention

The present invention relates generally to a launch environment simulator system and more specifically to a launch simulating system for simulating the launch of guidance system projectiles, such as missiles or rockets, along a line of sight path towards a target.

2. Prior Art

Various means have been devised in the past for aiming and guiding projectiles and other devices towards a target, including devices which take into account movement of the target as well as atmospheric and other conditions. However, in handheld launch devices the weight of the projectile is supported by the launch tube until the missile or projectile is launched out of the tube. At this point the operator who has been supporting the launch tube suddenly experiences a reduction in the weight of the apparatus in which he has been supporting as well as a great deal of flash and noise as a result of the launch of the missile, all of which combines to distract the operator from his original aim point and results in the loss of an inordinate amount of time while the operator recovers, thus causing the projectile to miss the target due to the operators inability to quickly re-aim the launch tube or otherwise place the missile or projectile back on its target path.

As operators become more experienced and accustomed to the explosive launch environment, the incidents of target loss and length of recovery time are lessened. However, the gaining of experience by the operator through the launch of actual operative projectiles is extremely expensive and requires, of course, operation in a dangerous environment in which the inexperienced operator could either injure himself or others. The instant invention overcomes these and other short-comings and disadvantages of known guidance launch simulation devices, particularly for line-of-sight operation, by providing a means for simulating the actual launch in a non-hostile environment.

Present launch effects training devices allow the operators to experience the relative feel of tube launched projectile. However, they include fixed recoil, do not obscure target during launch as in an actual launch, and do not simulate after-firing debris as in the actual launch situation, nor provide the proper sound pressure level. The instant device however, overcomes the foregoing disadvantages by allowing a selectable recoil, obscuring the target over a selectable range, providing a selectable sound pressure level and after firing debris.

In addition, the instant invention is low in cost as compared to other such devices. At least one attempt to provide obscuration of the target and generate sound pressure level similar to that in specific tube launched projectiles was based on a pyrotechnic launch device. However, pyrotechnic debris obscures the target to such a degree that it no longer provides simulation of the actual tube launch device, and provides yet another dangerous environment for the inexperienced operator as well as being high in cost.

SUMMARY OF THE INVENTION

The launch environment simulator (LES) includes a launch tube, combustion chamber and supply case, all of which is portable and may be taken into the field. The supply case houses oxygen, Mapp gas (a commercially available fuel gas used for home welding and brazing) and $CO_2$, and a battery and electronic control circuitry. The launch tube or round is set up with the bipod extended and a properly positioned tracker and trigger assembly mounted thereon. Appropriate connections are made to introduce the oxygen and Mapp gas into the round, and electrical connections are made. Oxygen and Mapp gas are then introduced into the interior of the round for a selected period of time, the fill time being proportional to amount of flash and noise desired on firing the round.

The operator who is to fire the round pulls the tracker trigger mounted on the launch tube, which causes a trigger signal to be sent from the round to the electronics. The electronics provides the proper delay before ignition and launch of a missile that one would normally experience when firing an actual operative projectile. The Mapp gas and oxygen is ignited by a glow plug which is driven by the electronics package. Upon ignition, the Mapp gas and $O_2$ combination creates a sound pressure level and flash similar to that experienced when firing the actual round. End caps are provided which are placed fore and aft to contain the Mapp gas and $O_2$ in the launch tube until ignited. Recoil is provided by attaching an appropriately sized orificed end plate to the launch tube. The end caps provide the gas seal of the tube until firing and also contain a smoke-producing agent to further simulate the actual firing environment, while the size of the orifice determines the amount of recoil. A specific embodiment of the invention and the subparts thereof are specifically described hereinafter with reference to the drawings.

BRIEF DESCRIPTION OF THE DRAWINGS

FIG. 3 is an exploded view of the LES launch tube and combustion chamber.

FIG. 4 is an objective view of the LES tube in the ready position having the tracker mounted thereon.

SPECIFIC EMBODIMENT OF THE INVENTION

Figure 1:
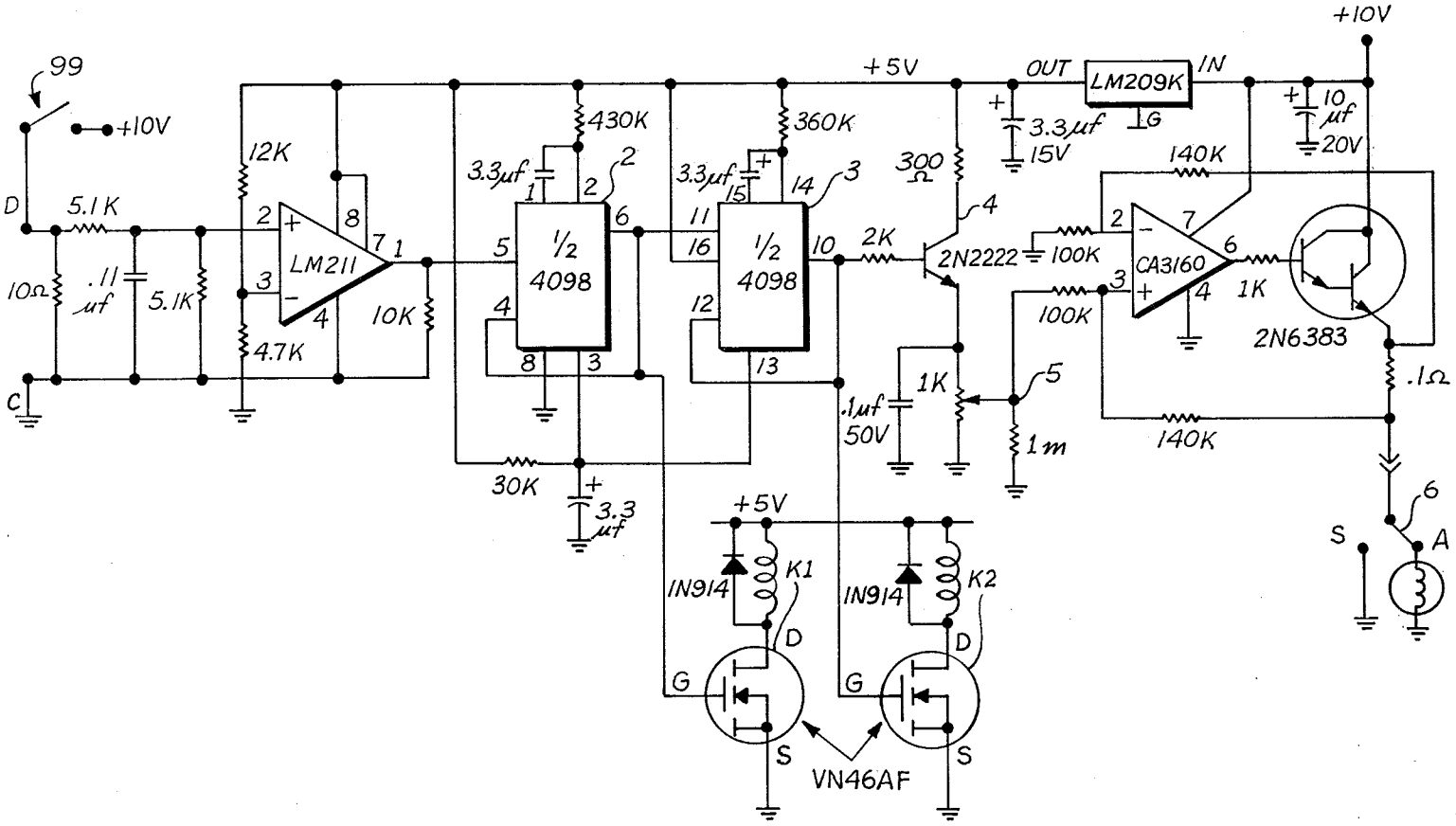
FIG. 1 is a schematic diagram of the electronic circuit used to control the LES.

With specific reference to the figures, FIGS. 3 and 4 show the launch simulator tube 10 having an outer housing 11 similar in appearance and structure to the actual launch tube. In FIG. 4, it is noted that the simulated tube 10 is made further realistic by including the bipod 14 which accepts an actual tracker trigger assembly 16. Again referring to FIG. 3, we note combustion chamber 20, charge cups 22 and 24, and orifice plate 26 for receiving the rear most charge cup and providing the proper selected recoil. Three such orifices are provided although it is recognized that an infinite number of different orifices would provide an infinite range of recoil so long as the forward opening of the tube 10 is larger than the orifice.

The combustion chamber or inner tube 20 is seated by insertion of the forward and aft charge cups 22 and 24 respectively. When the gas inside the combustion chamber 20 is ignited by the glow plug, the gases cause a flash both forward and aft of the device and observed thermal scintillation along with sound pressure levels equivalent to that of the actual launch environment. The charge cups are destroyed in the firing, which creates the debris which simulates the actual launch. In fact, the operator is actually struck by debris from the aft cup just as he is in the actual firing of a live round.

Figure 6:
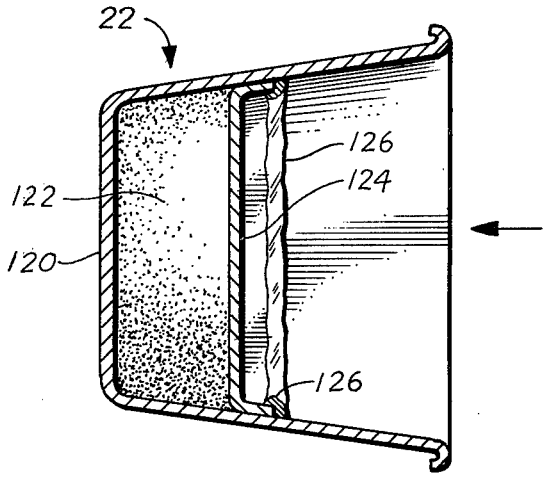
FIG. 6 is a cross sectional side view of the forward charge cup.
Figure 7:
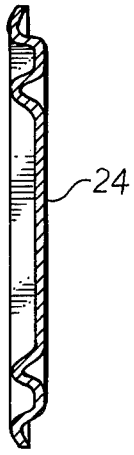
FIG. 7 is a cross sectional side view of the aft charge cup.

More specifically, charge cups 22 and 24 are shown in FIG. 6 and FIG. 7. In FIG. 6, the forward charge cup number 22 is an assembly comprising a paper bowl (or other light-weight material) 120 to which the smoke-producing agent 122 is added. A paper lid 124 is placed inside the bowl in order to contain the smoke-producing agent 122. The lid is retained with a bead of sealant 126 around the circumference. This forward cup provides the forward gas seal, the necessary debris and smoke, and will actually fit in either the forward or aft ends of the device.

Figure 9:
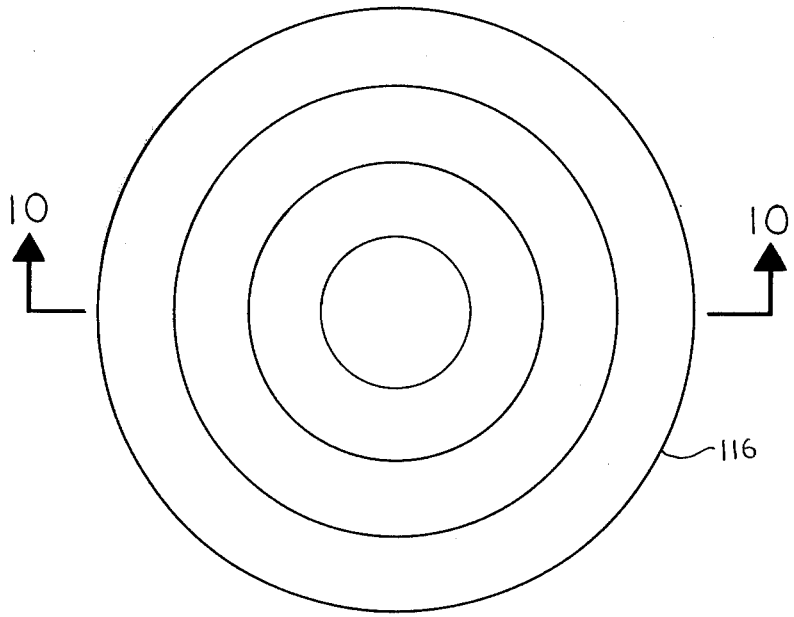
FIG. 9 is a front elevational view of a modified biodegradable fore and aft charge cup.
Figure 10:
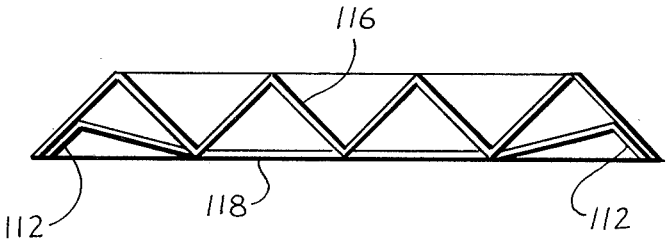
FIG. 10 is a cross sectional side view of the biodegradable fore and aft charge cup.

FIGS. 9 and 10 illustrate an alternate of construction for the charge cups which will fit either the forward or the aft end; in particular, a charge cup formed as shown in FIG. 10 having an upper surface 116 which forms a plurality of concentric circles as shown in FIG. 9 having a generally triangular cross secton. A lower surface 118 of a generally circular configuration is received by said upper section 116 and is insertable therein, thereby sealing the cavities formed in upper section 116. The ends 112 of the lower portion 118 are indented slightly into the cavity of section of the upper member 116 so as to form a recess for receiving the edges of the launch tube in a manner similar to the aft charge cup 24. Contained within the cavities formed by the triangular sections of the upper member 116 is the smoke-producing agent 122 added in the forward charge cup 22 so that upon ignition the alternate charge cup will react in much the same manner as charge 22 does as described below. It is preferrable that the alternate charge cup be made of a biodegradable substance of sufficient strength to maintain its shape and remain in place upon the launch tube and provide the sealing function heretofore described.

The aft charge cup 24 is a standard plastic lid similar to the type placed on a drink cup for take-out at fast food restaurants, for example. It is so constructed that it will only fit on the aft end of the LES at the recoil orifice plate 26. It produces the gas seal function at the aft end and does provide debris functions as described above as well. Charge cup 24 does not, however, contain the smoke producing agent and is a low-cost device for the described use. To refire the device, new charge cups are installed and the system recharged and used again.

Figure 2:
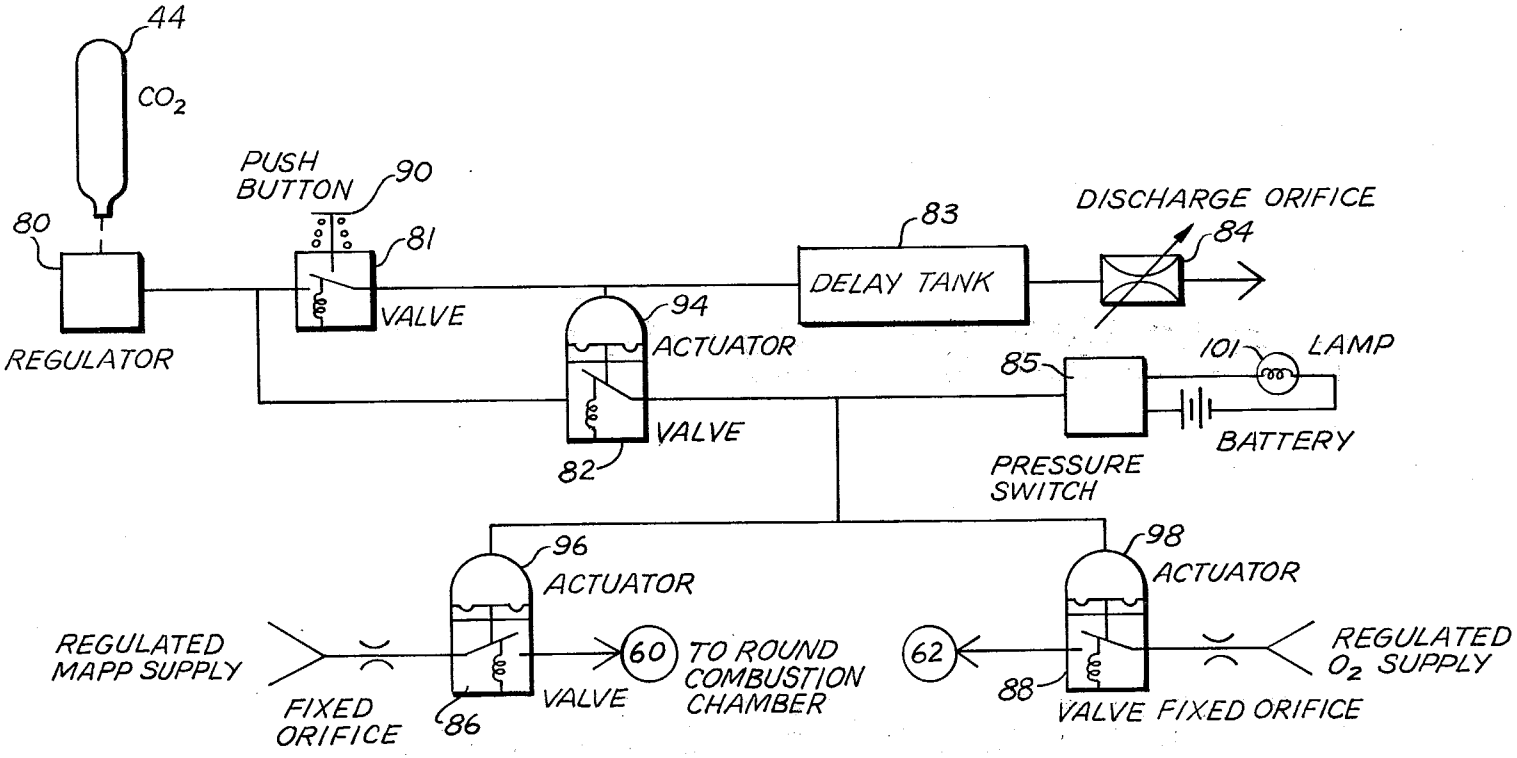
FIG. 2 is a schematic diagram of the pneumatic metering system and combustible gas supply mechanism.
Figure 5:
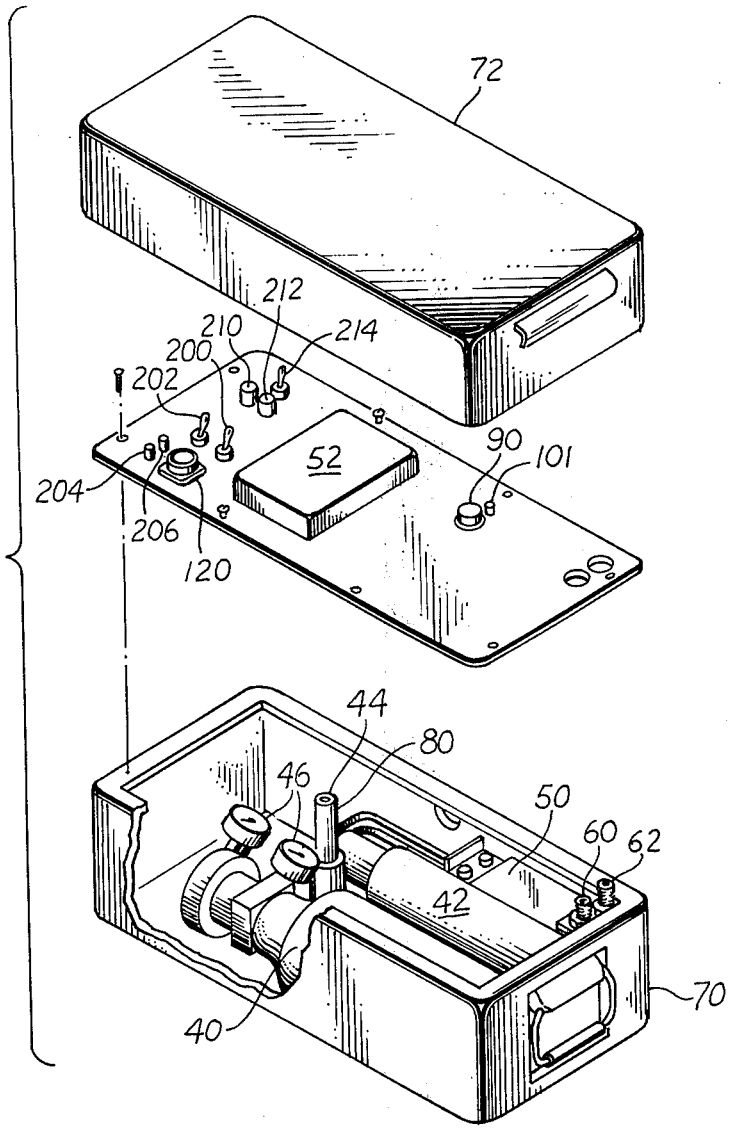
FIG. 5 is an exploded view of the supply case which contains the combustible materials power supply and the electronics.

FIG. 5 illustrates an exploded view of the supply case which is used to house the $O_2$ supply canister 40, the Mapp gas supply canister 42, a $CO_2$ cartridge 44 which is penetrated on insertion and remains sealed in the system. Also included are various pressure gauges 46 which are used to monitor the gas supplies, the battery supply 50 which provides the power for the electronic package 52. $O_2$ and the Mapp gas are made available to the LES launch simulator tube 10 through conventional gas connectors 60 and 62 respectively. Gas is made available by a pneumatic metering system which supplies the correct amounts of combustible gases to produce the required sound pressure levels. This system is shown schematically in FIG. 2.

The typical operation would be as follows: The $CO_2$ cylinder 44 is pierced when it is installed into its regulator assembly 80 within the supply case 70. The regulated $CO_2$ gas flows into the inlet of valves 81 and 82. When charging of the LES launch simulator tube prior to firing is desired, the operator depresses a push button 90 which opens the valve 81. The regulated $CO_2$ gas then flows into a delay tank 83 and then through an adjustable discharge orifice 84. When sufficient pressure has been built up in the delay tank, the increase in $CO_2$ pressure communicates with an actuator 94 which opens valve 82. Thus, although the push button will be released, valve 82 will remain open so long as sufficient pressure remains to operate actuator 94. After a certain period of time, however, the $CO_2$ will escape through the discharge orifice 84 and eventually reduce the pressure on actuator 94 to ambient, thus allowing valve 82 to close. The period of time that the actuator 94 will hold valve 82 open is determined by appropriate selection or adjustment of the variable discharge orifice 84. When valve 82 is opened $CO_2$ is supplied to a pressure switch 85 which activates a lamp 101 for a visual indication of gas flow and to a Mapp gas actuator 96 which opens the Mapp gas valve 86 and communicates map gas to the combustion chamber 20.

Simultaneously, pressure is applied to oxygen supply actuator 98 which similarly opens an oxygen valve 88 and supplies oxygen to the combustion chamber 20. The valves, in fact, communicate the gas to gas hose fittings 60 and 62, and a conventional gas line hose is used to interconnect the supply case with the launch simulator tube.

Figure 8:
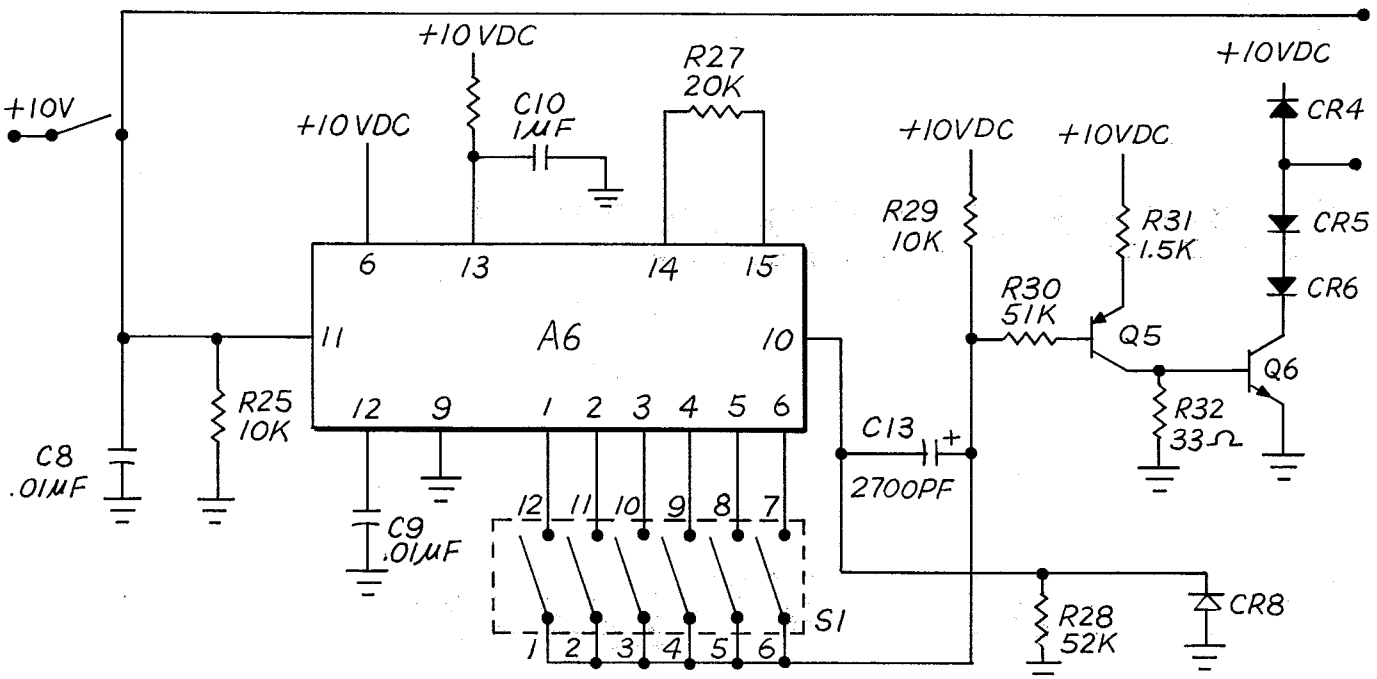
FIG. 8 is a circuit diagram of the electronic metering sytem.

As may be noted in FIG. 5, the supply case supports the fittings 60 and 62 to which the gas line hose, normally stored within the supply case cover 72, is attached for communication of gas to gas manifold 27 shown in FIG. 3. The metering of the gas into the chamber can be accomplished electronically by an appropriate electronic timing circuit which electrically activates the Mapp gas and oxygen valves for the appropriate fill time which may be electrically adjustable. Such a circuit is illustrated in FIG. 8. Device 26, the recoil orifice, is attached to the combustion chamber 20, and the gas lines attach at fittings 102 and 104 respectively. The forward end of the gas manifold 27 is depressed slightly and provided with a bracket 100 for mounting within slot 106 of the combustion chamber 20 and is positioned down and away from the forward section of said tube such that charge cup 22 may be inserted therein to seal the system. The opposite end 108 is fastened to the inner portion of combustion chamber 20.

In FIG. 4 it may be noted a tracker connection 140 provides the electrical interconnection for ground leads and for leads to the redundant glow plugs 112 and 114 of FIG. 3 (selected by switch 202 of FIG. 5), to the LES supply case as shown in FIG. 5 and to the trigger which is not shown but is simply a closing switch to the electronics package, such interconnection providing a source of current for the battery 50 to the glow plugs after an appropriate delay as described herein. The specific wiring and interconnection is not shown and is noted as being obvious to anyone skilled in the art.

The electronics in the supply case are schematically represented in FIG. 1. With reference to FIG. 1, the circuit operation is as follows: a trigger signal is filtered and voltage discriminated to eliminate false triggering of the LES. A voltage comparator performs a voltage discrimination and triggers a 700 millisecond one-shot circuit 2 as shown on the diagram. The one-shot output drives a power FET to activate relay K1 for the 700 millisecond time period. The normally closed contacts are opened, furnishing the trigger signal to a monitor set.

At the end of the 700 millisecond delay, a second one-shot circuit is activated, generating a 600 millisecond output pulse. The second output pulse drives a second power FET and relay power combination, K2, which furnishes the contact closure to the monitor set, simulating the first Motion Discreet signal (first motion of projectile). This output also activates an emitter follower stage 4 that provides an input voltage to an adjustable constant current source. The output current is controlled by the amount of voltage applied to the input. A potentiometer 5 facilitates current adjustment. The constant current source uses a 0.1 ohm resistor in series with the glow plug load to sense the nominal 2 amp current. Thus the output current is constant over a range of battery voltages from approximately 8 to 11 volts and variable load resistances. The output current, of course, heats the glow plug and ignites the gases. Specific circuit components and interconnection, along with device identification are shown in the circuit diagram.

Typical operation for the instant invention would be as follows. When the LES is deployed for field use, the round is set up with the bipod extended and a tracker positioned properly thereon. The supply case lid is then opened and the 25 foot cable removed. At the supply case this cable connects to the 16 pin electrical connector 120. The oxygen (green) and the MAPP (red) hose connections are then made. The hose connections are further provided with different thread, oxygen being right-handed and MAPP being left-handed, so as to prevent incorrect connection. At the launch simulator tube the oxygen and MAPP connections are made to the gas manifold at 102 and 104 and the remaining electrical cable of the 25 foot cable is attached to the electrical connector 140. When the monitor set is being used, a monitor cable breakout from the 25 foot cable connects directly to the monitor set.

The instructor then prepares the LES for firing by opening the supply control panel to obtain access to the $O_2$ and MAPP bottles. The oxygen and MAPP bottles shut off valves are then open. $O_2$ and MAPP gauges are observed to verify that the regulators are properly set. The fill time is set and verified by the use of any timing mechanism such as a watch or other device. The operator is instructed to take up a firing position.

When the operator is ready, the instructor places the ON/OFF switch 200 to ON and verifies that the unit is safe by observing a GREEN light 210 on the supply control panel. This indicates that the switch 6 shown on the electrical schematic is in the S or safe position shunting current to ground. The instructor then places the end caps on the round. The fill is initiated by pressing the fill switch 90, and the YELLOW light 101 will come on and stay on for the duration of the fill, then extinguish. The instructor then places the safe/arm switch 214 to ARM, in FIG. 1, thereby interconnecting the glow plug with the electronics and at the same cause the GREEN light to go OFF and the RED light 212 to go ON.

The specific interconnection of these RED and GREEN lights is not shown and may be accomplished in any conventional manner. The operator is then informed to fire at will. As the operator pulls the trigger 99, a trigger signal is sent from the launch simulator tube from the 25 foot cable to the supply case electronics and is electrically processed as described above.

While the specific embodiment of this invention has been heretofore described and shown in the accompanying drawings, it is understood that such an embodiment is merely illustrative of and not restrictive on the broad invention and is not limited to the specific construction or arrangement described but includes all equivalents and the various modifications thereof occurring to persons having ordinary skill in the art.

Accordingly, I claim:

1. A launch environment simulation apparatus comprising:

a. an elongated combustion chamber open at both ends;

b. means for charging the chamber with a combustible gas mixture;

c. means for igniting the gas selectable by an operator;

d. a recoil producing means comprising a plate removably attached to the rear end of the chamber wherein the plate contains at least one orifice such that the total orifice area provides an effective amount of recoil sensible to the operator of the apparatus upon ignition of the gas mixture; and e. means for containing the combustible gas mixture within the chamber prior to ignition of the gas comprising end caps removably attached to both ends of the chamber wherein the caps disintegrate upon ignition of the gas.

2. An apparatus as described in claim 1 wherein said charging means comprises:

a. source of combustible gas, b. means for predetermining the amount of combustible gas to be introduced into said chamber, and c. means for introducing said predetermined amount of gas into said chamber.

3. An apparatus as described in claim 2 wherein said means for predetermining the amount of combustible gas introduced into said chamber comprises:

a metering system which includes:

a. control means, b. at least one valve normally closed for communicating said combustible gas, c. means for actuating said valve upon responsive to said control means, and d. means for regulating the duration said valve is actuated by said valve actuating means for a predetermined period of time.

4. An apparatus as described in claim 3 wherein said control gas introducing means and said regulations means comprises:

a. a control gas source, b. a first control gas valve normally closed adapted for momentary manual opening for communicating said control gas, c. storage means coupled to said first control valve for storing a predetermined volume of control gas upon opening of said valve, and d. a discharge orifice coupled to said storage means opposite said first valve for discharging said volume of control gas to the atmosphere at a predetermined rate, and wherein said valve actuating means is coupled between said first valve and said storage means.

5. An apparatus as described in claims 1, 2, 3 or 4 wherein said igniting means comprises:

a. a trigger switch, b. means for detecting the position of the contacts of said switch, c. means for selective generation of an electric current responsive to at least one position of said contacts detected by said detecting means, d. heating means for heating said combustible gas to its ignition point operable upon application of electrical current, and e. means for applying said generated current to said heating means.

6. An apparatus as described in claim 5 wherein said applying means comprises:

a. means for selectively coupling said heating means and said current generating means.

7. The launch simulator of claim 1 wherein the igniting means comprises:

a. a trigger for generating a signal as an indication of the initiation of a simulated launch, and b. an electronic circuit for processing the trigger signal and igniting the gas.

8. The simulator of claim 7 wherein the electronic circuit in the igniting means comprises:

a. a filter section for generating a filtered signal in response to said trigger signal, b. a delay section for generating a delay signal in response to said filtered signal, c. a current generation section for generating current in response to said delay signal, and d. ignition means within said combustion chamber driven by said current.

9. A simulator as described in claims 7 or 8 wherein said means for introducing a combustible mixture into said chamber comprises:

a. a source of control gas, b. a regulator having an output said regulator coupled to said source for outputting regulated control gas, c. at least one first valve having an input and an output said input coupled to said output of said regulator, d. at least one second valve having an input and an output said input coupled to said output of said regulator, e. means for actuating said first valve adapted for manual actuation, f. means for actuating said second valve having an input coupled to said output of said first valve said means adapted for actuation upon application of control gas pressure at said input, g. a source of combustible mixture, h. at least one mixture valve having an output coupled to said combustion chamber and an input coupled to said combustible mixture source, and i. a means for actuating said mixture valve having an input coupled to said output of said second valve said means adapted for actuation upon application of control gas pressure at said input.

10. A simulator as described in claim 9 wherein said introducing means further comprises:

a. a delay tank having an input and an output for storing a predetermined volume of control gas, said input coupled to the output of said first valve and the input of said second valve actuating means, and b. a discharge orifice coupled to the output of said tank for discharging said control gas at a predetermined rate.

11. A simulator as described in claim 10 wherein said introducing means further comprises:

a. a pressure actuable switch coupled to said output of said second valve, and b. a display means activated by said switch for indicating the actuation of said mixture actuation valve means.

12. The launch simulator of claim 1 wherein the end cap removably attached to the front end of the chamber contains a smoke producing agent which is actuated by the ignition of the gas.

* * * * *